US006022075A

United States Patent [19]

Blocker et al.

[11] Patent Number: 6,022,075

[45] **Date of Patent: *Feb. 8, 2000**

[54] CHAIR CUSHION

[75] Inventors: Douglas L. Blocker, County of Jefferson; Ray G. Kelly; Sharon A. Turnbough, both of St. Louis County, all of Mo.; Francois Seve, Chassieu, France

[73] Assignee: Angeles Group Inc., Pacific, Mich.

[ * ] Notice: This patent is subject to a terminal disclaimer.

[21] Appl. No.: 08/916,518

[22] Filed: Aug. 22, 1997

[51] Int. Cl.[7] ..... A47C 1/08; A47C 7/18

[52] U.S. Cl. ..... 297/251; 297/219.1; 297/448.1; 297/452.26; 297/452.23; 297/452.55

[58] Field of Search ..... 297/440.11, 440.14, 297/452.23, 452.26, 452.21, 219.1, 251, 250.1, 452.55, 448.1, 228.12, 256; 5/653

[56] References Cited

U.S. PATENT DOCUMENTS

| | | | |
|---|---|---|---|
| D. 358,723 | 5/1995 | Kelly et al. . | |
| 2,135,657 | 11/1938 | Church | 297/452.55 |
| 2,205,302 | 6/1940 | Morgenstern | 297/228.12 X |
| 3,220,767 | 11/1965 | Hendrickson | 297/452.55 |
| 3,537,752 | 11/1970 | Kushnarov et al. | 297/452.26 |
| 4,231,613 | 11/1980 | Jonassen et al. | 297/250.1 |
| 4,461,510 | 7/1984 | Cunningham et al. | 297/250.1 |
| 4,828,320 | 5/1989 | Saiger | 297/448.1 |
| 5,599,068 | 2/1997 | Kelly et al. . | |

*Primary Examiner*—Anthony D. Barfield
*Attorney, Agent, or Firm*—Woodard, Emhardt, Naughton, Moriarty & McNett

[57] ABSTRACT

A portable cushion to use with a chair having a seat with upwardly extending elements which may be hip supports or arm rests on each side of the seat having a material thickness sufficient to raise the seating area above the plane of the arm rests or hip supports so as to effectively increase the seating area of the seat. The cushion includes a top wall, a bottom wall, a forward wall, a rearward wall, a first side wall and a second side wall, the respective wall defining a material thickness. The first side wall and the second side wall each have an indentation formed therein to accommodate the upwardly extending arm rest or hip support when the cushion is placed upon the seat of the chair. The material thickness of the cushion is such that the upper wall of the cushion extends at least to the height of the upwardly extending elements thereby effectively creating a wider seat, unencumbered by the upwardly extending elements.

11 Claims, 5 Drawing Sheets

CHAIR CUSHION

CROSS REFERENCE TO RELATED APPLICATION

None

BACKGROUND OF THE INVENTION

This invention relates generally to furniture, more particularly to as cushion for use with a chair for use by small children to convert the chair to a chair which is comfortable and functional for a larger person, either a larger child or adult.

Classroom or institutional furniture is known in the art. Chairs, for example, that are used by small children in the preschool classroom traditionally have been downsized replicas of full-sized institutional furniture. Quite often these chairs lack aesthetic appeal in that they do not blend in well with other preschool type furniture. More importantly, these chairs are not designed with safety in mind. For example, such furniture is designed to fold for storage, which can create a pinching hazard. The furniture also may have gaps in which a small child may catch an arm or leg. Further, such prior art furniture may have comers.

Traditional, downsized furniture also may lack functionality. This type of furniture may be heavy and difficult to move about the classroom. The furniture may not stack for convenient storage and it may be constructed of a material that lacks durability. Such traditional furniture may be difficult to assemble and not well adapted to the classroom environment.

Many of the problems and shortcomings associated with prior art, downsized furniture were address by the invention disclosed in U.S. Pat. No. 5,599,068, to Kelly et al., the disclosure of which is hereby incorporated by reference. The chair disclosed in the patent is a safe, molded chair that is well suited for its intended use in a classroom setting. However, since a commercial embodiment of the disclosed chair is dimensioned to accommodate small children, it does not easily accommodate a larger individual, such as the teacher. For example, chair disclosed in U.S. Pat. No. 5,599,068 has a plastic body section and a pair of arch-shaped tubular leg element. The apexes of the bows of the arch-shaped legs elements extend above the plane of the seat and can function as arm rests are hip supports for the smaller user. An adult user of the chair may have difficulty fitting between the arch-shaped tubular leg elements so as to comfortably rest on the seat. In the classroom setting, if a larger person, for example the teacher, desires to sit on a chair next to or among the students, he or she must get a larger chair or sit in an uncomfortable position on the smaller chair. It would be advantageous, therefore, to have a portable or removable, lightweight cushion device that can be placed on the seat of a chair having arm rests or hip supports that effectively increases the seating area of the chair so as to accommodate a larger user.

SUMMARY OF THE INVENTION

It is among the principal objects of the invention to provide a cushion device that can be placed upon a chair to increase the seating area of the chair.

It is another object of the invention to provide a cushion device that can be placed on the seat of a chair having arm rests or hip supports to effectively elevate the seating area of the seat above the plane of the arm rests or hip supports.

It is still another object of the invention to provide a cushion device that is designed to conform to the shape of a chair seat and to accommodate arm rests or hip supports positioned on each side of the chair seat.

Another object of the invention is to provide a cushion device that fits securely on an existing chair without the necessity of additional securing means.

It is still another object of the invention to provide a cushion device that is removable lightweight and portable that can be moved from one chair to another.

Yet another object of the invention is to provide a cushion device that is made from durable and resilient materials, that is lightweight and easy to transport, supportive, comfortable and well suited for its intended purposes.

Briefly stated, a portable, durable cushion is provided to use with a chair having a seat with upwardly extending elements which may be hip supports or arm rests on each side of the seat having a material thickness sufficient to raise the seating area above the plane of the arm rests or hip supports so as to effectively increase the seating area of the seat and to secure the cushion between the upwardly extending elements. The cushion includes a top wall, a bottom wall, a forward wall, a rearward wall, a first side wall and a second side wall, the respective wall defining a material thickness. The respective walls can be fashioned from a resilient material such as vinyl, leather or so forth. The material thickness can be comprised of a supportive foam material. The first side wall and the second side wall each have an indentation formed therein to accommodate the upwardly extending arm rest or hip support when the cushion is placed upon the seat of the chair. The material thickness of the cushion is such that the upper wall of the cushion extends at least to the height of the upwardly extending elements thereby effectively creating a wider seat, unencumbered by the upwardly extending elements.

The preferred embodiment of the cushion is designed to use with a small preschool classroom chair having arch shaped leg elements. The bows of the arch-shaped leg elements extend above the chair seat and function as arm rests or hip supports when the chair is occupied by a small individual such as a child. The cushion has a generally rectangular shape which conforms to the general shape of the chair seat. Each side of the cushion has a recess which allows the cushion to be placed on the chair seat and the bows of the leg elements to fit into the recesses. The recesses effectively grip the bows of the leg elements to secure the cushion in place without additional securing means. The material thickness of the cushion is such that the upper wall or surface is at about the same height as the apexes of the bows of the leg elements when the cushion is resting on the chair seat. The upper surface of the cushion creates a planar seat which extends across the bows and effectively creates a wider seat. An alternative embodiment of the cushion includes a waffled lower wall that includes less cushion material thereby reducing the weight of the cushion. Further, a cushion could be formed from a Styrofoam skeleton with a polymer coating and surface padding. The cushion is lightweight, removable and portable and can be carried about by a teacher, for example.

DESCRIPTION OF THE PREFERRED EMBODIMENT

Figure 1:
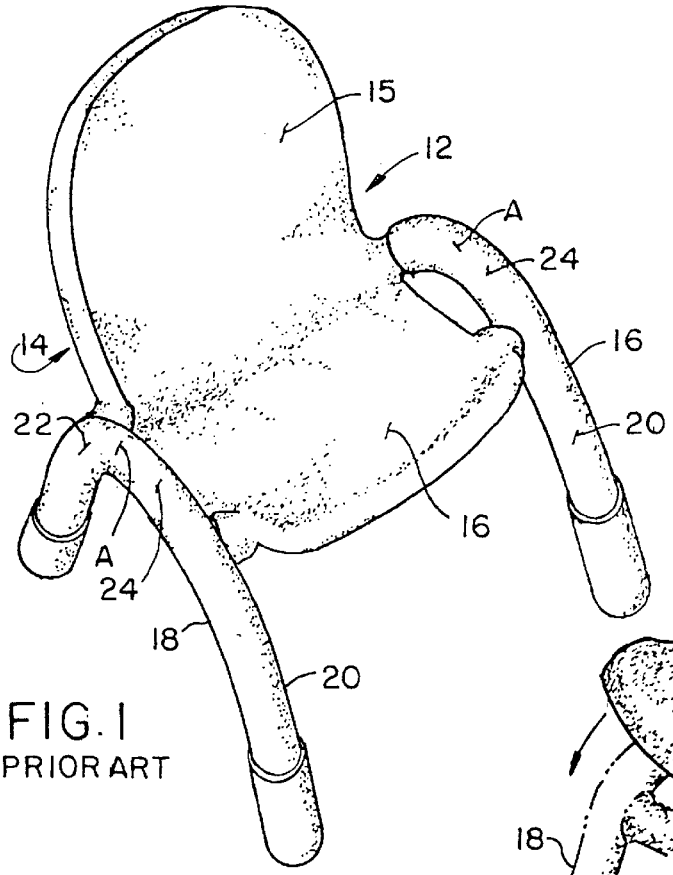
FIG. 1 PRIOR ART
FIG. 1 is perspective view of a prior art arcuately supported chair of the type with which the preferred embodiment of the cushion of the present invention is intended to be used.
Figure 2:
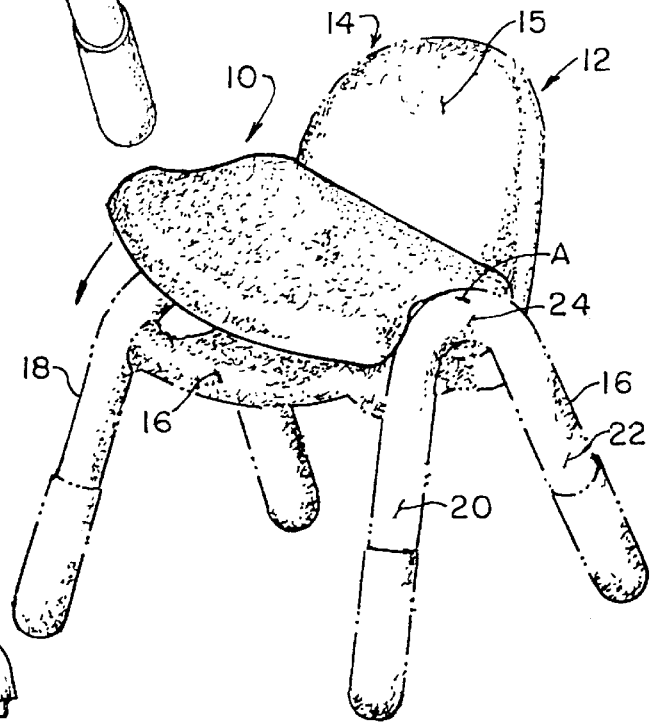
FIG. 2 is a perspective view of the chair of FIG. 1 is the cushion of the present invention partially in place.

The novel cushion of the present invention is indicated generally in the drawings by reference numeral 10. Cushion 10, in its preferred embodiment, is intended to be used with a chair as indicated by reference numeral 12 in the drawings, constructed in accordance with the principles disclosed in U.S. Pat. No. 5,599,068, which is hereby incorporated by reference.

In general, chair 12 includes a molded plastic body section 14 having a back 15 and a seat 16 and a pair of arch-shaped tubular leg elements 16 and 18. Leg element 16 and leg element 18, which is essentially a mirror image of leg element 16, are arch-shaped, tubular structures with two legs 20 and 22. Each leg element has a bow 24 formed centrally by the bending of the leg element which serves as an arm rest and/or a hip support. It will be appreciated that each apex A of each bow 24 extends above the plane of seat 16, thus restricting the lateral area of the seat. The cushion 10, which is constructed in accordance with the following principles, is placed on seat 16 to increase the lateral seating area of the chair.

Figure 3:
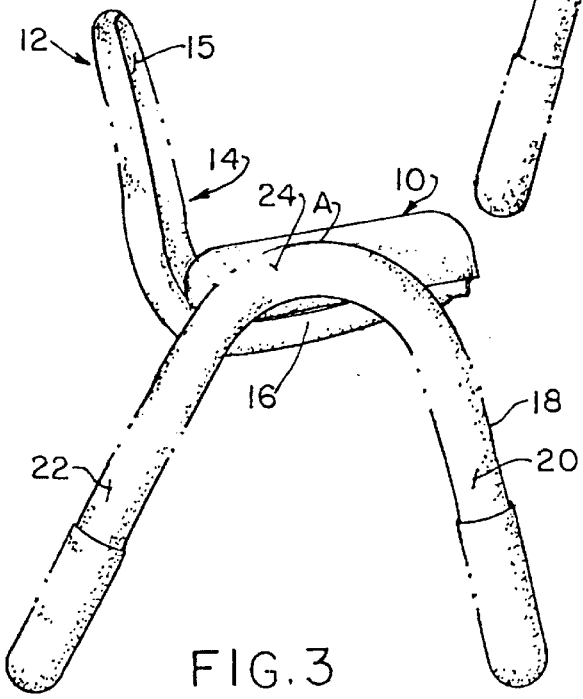
FIG. 3 is a side elevational view of the chair of FIG. 1 with the cushion of the present invention in place thereon.

Cushion 10, as best seen in FIGS. 4–7, includes a top wall 30, a bottom wall 32, a front end wall 34, a rear wall 36, a first side wall 38 and a second side wall 40. The respective walls can be constructed of a durable, resilient material such as vinyl, leather or so forth that is easy to fabricate, easy to keep clean, and well suited for its intended purposes. Also, it is important to note that any of the aforestated walls can be fabricated as separate or integral pieces without departing from the scope of the invention. The recited walls define an interior chamber 44 which is filled with a material thickness 46. The material thickness 46 can be fabricated from a deformable, resilient material such as foam rubber or the like. As best seen in FIG. 3, the dimensions of the front, rear, and side walls, as well as the thickness of the material thickness 46 is of such appropriate dimensions so as to allow the top wall 30 to be elevated at least to and preferably, somewhat above, the plane between the apexes A of the bows 24 when cushion 10 is resting on seat 16.

Figure 4:
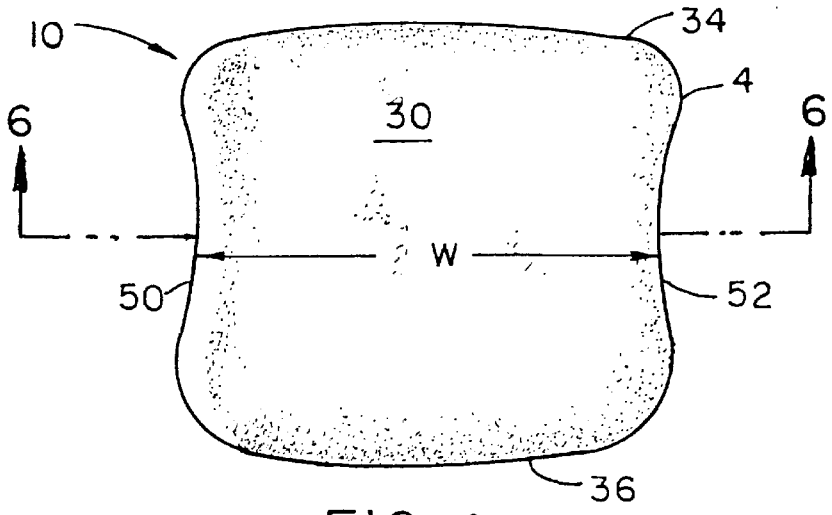
FIG. 4 is a top plan view of the cushion of the present invention.
Figure 5:
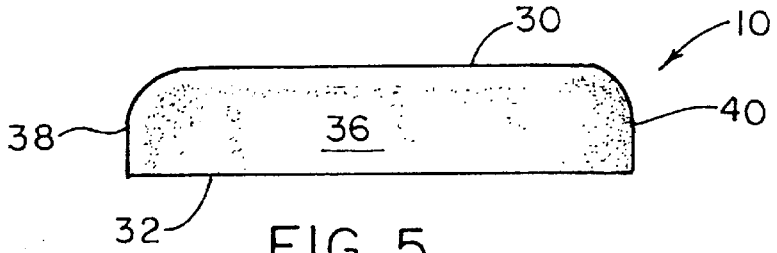
FIG. 5 is an rear elevational view thereof.
Figure 6:
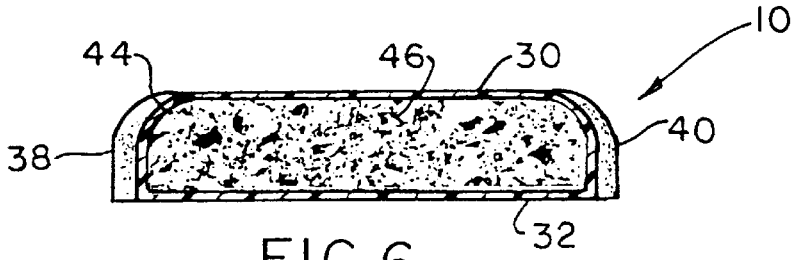
FIG. 6 is a cross-sectional view taken along line 6—6 of FIG. 4.
Figure 7:
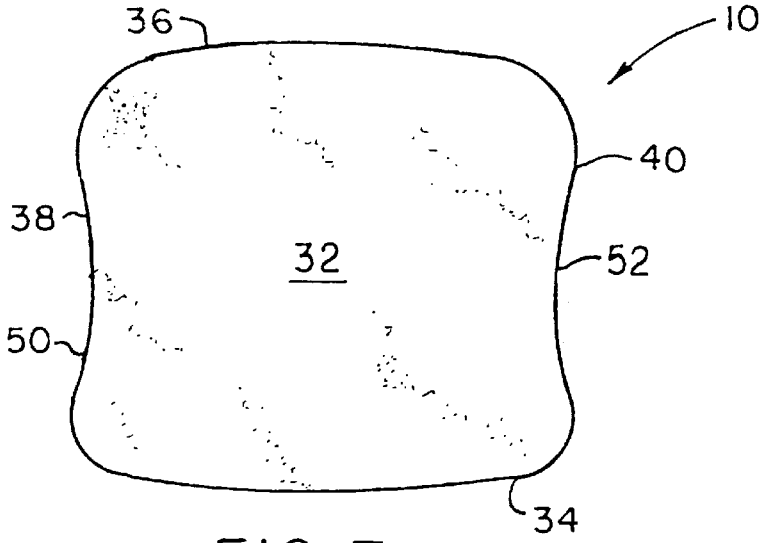
FIG. 7 is a bottom plan view of the cushion of the present invention.
Figure 8:
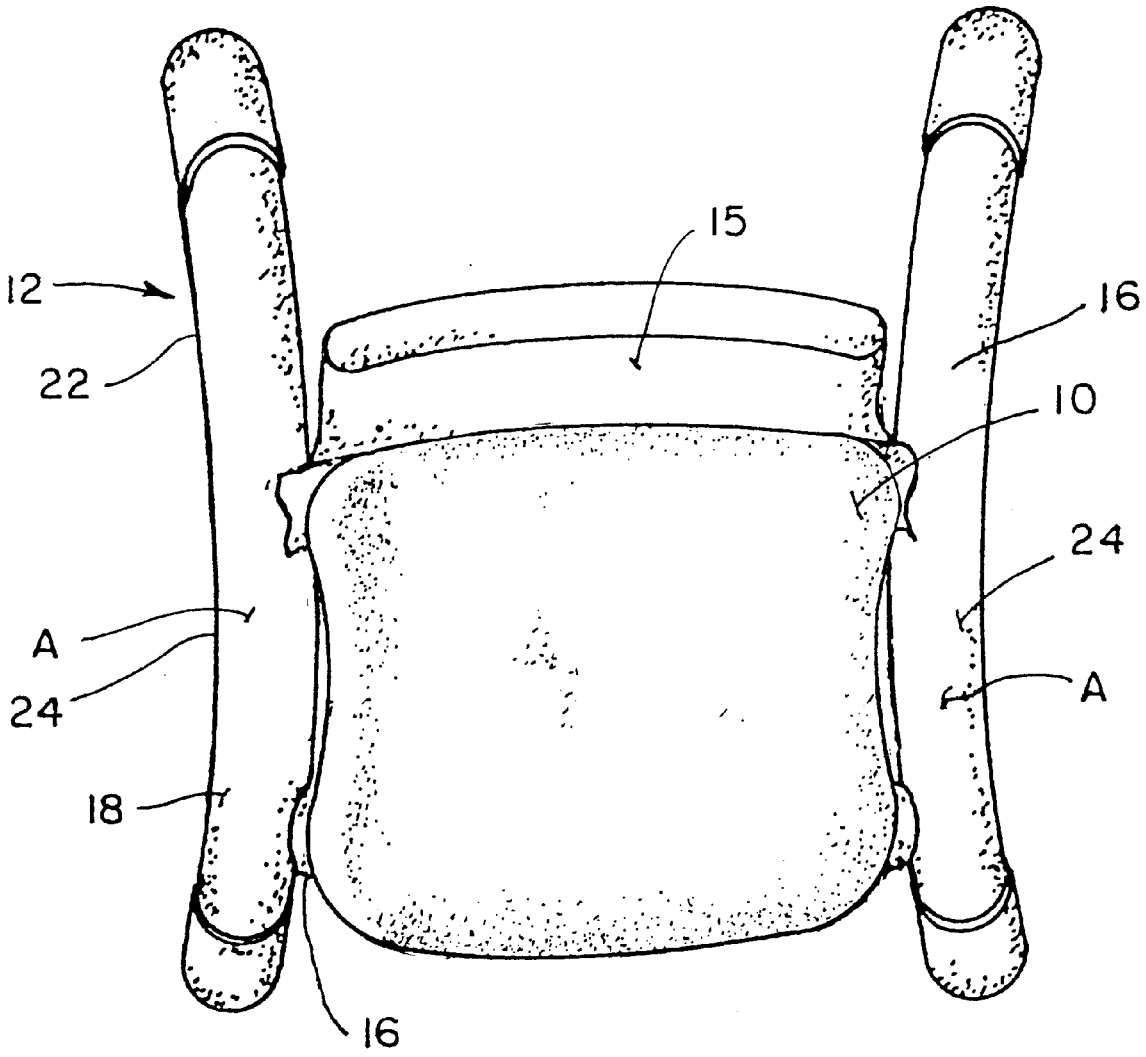
FIG. 8 is a top plan view of a cushion of the present invention placed on a chair.
Figure 9:
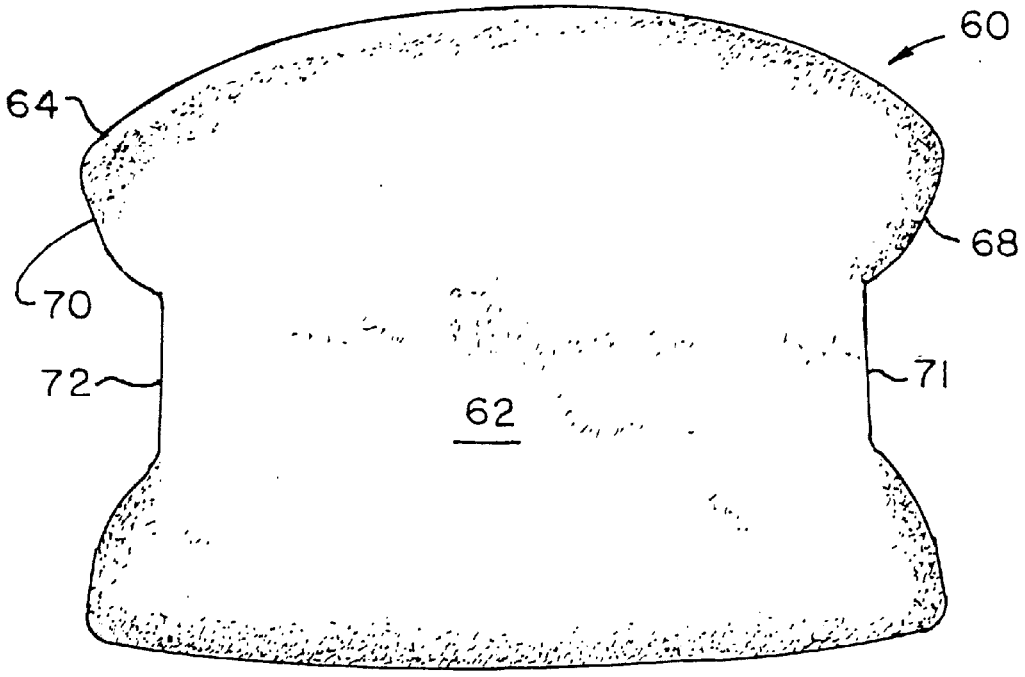
FIG. 9 is a top plan of an alternative embodiment of the cushion of the present invention.
Figure 10:
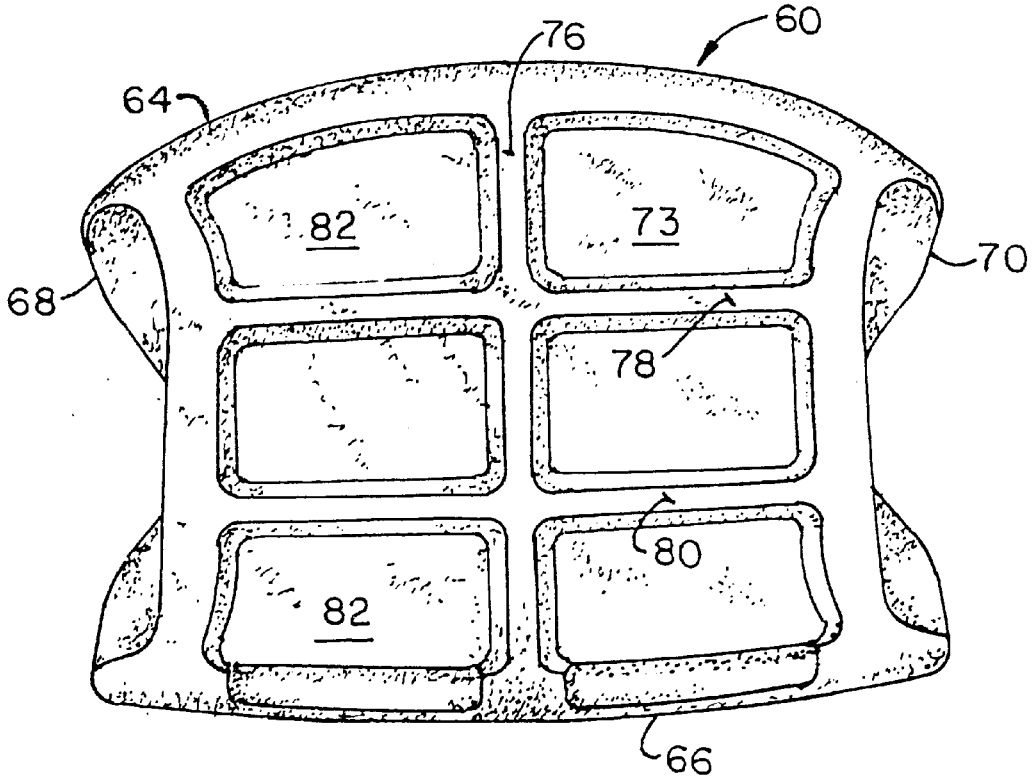
FIG. 10 is a bottom plan thereof.
Figure 11:
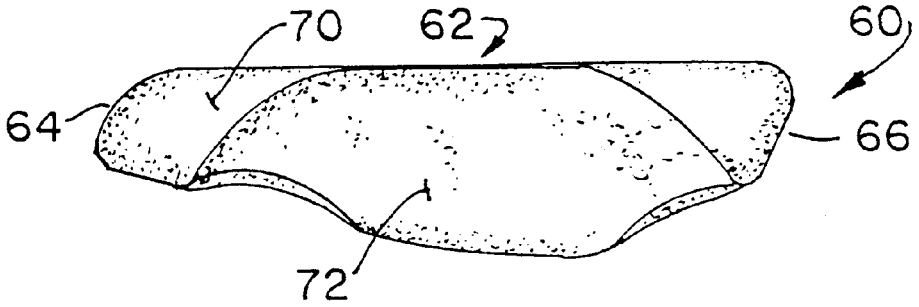
FIG. 11 is a side elevational view thereof.
Figure 12:
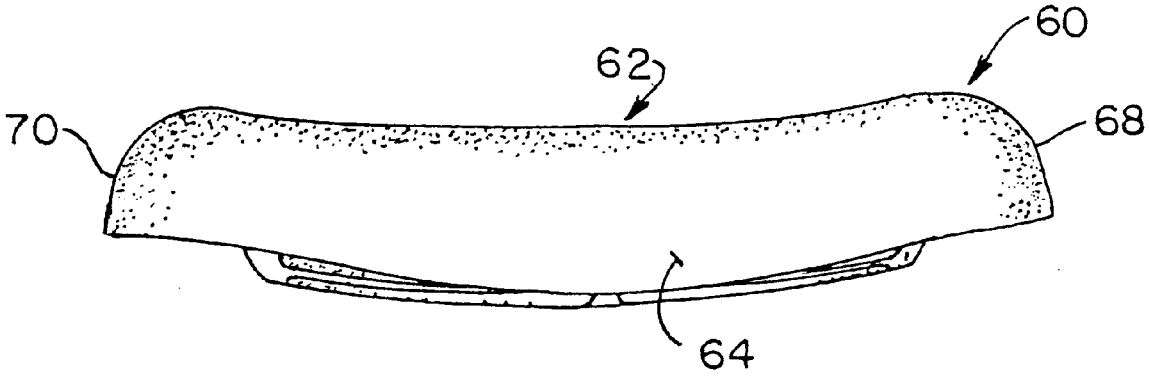
FIG. 12 is a front elevational view thereof.
Figure 13:
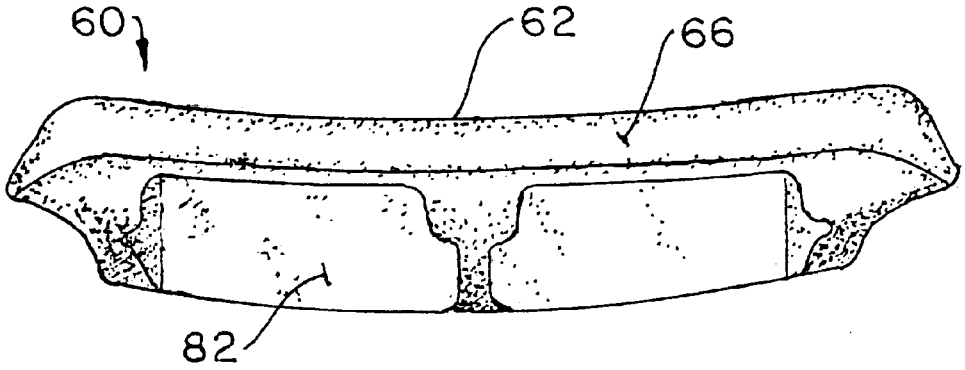
FIG. 13 is a rear elevational view thereof.

As seen in FIGS. 4 and 7 side wall 38 includes indentation 50 and second side wall 40 includes an indentation 52. As will be appreciated, the respective indentations 50 and 52 encroach into the material thickness of the cushion to reduce the width of the cushion at point W. Further, the indentions 50 and 52 are dimension so as to allow the seating of the bows 24 of the two leg elements, as best seen in FIG. 8. The bows 24 nest securely in the indentations so that the cushion fits snugly with a friction fit and is secured into place without additional securing means.

FIGS. 9 through 13 illustrate an alternative embodiment of the cushion of the present invention indicated generally by reference numeral 60. Cushion 60 includes a top wall 62, a front end wall 64, a rear wall 66, a first side wall 68 and a second side wall 70. The respective side walls have indentions 71 and 72 which function to accommodate the chair leg bows as previously described and to secure the cushion in place. The respective walls can be constructed of a durable, resilient material such as a polymer, foam, vinyl, leather or so forth that is easy to fabricate, easy keep clean, and well suited for its intended purposes. Also, it is important to note that any of the aforestated walls can be fabricated as separate or integral pieces without departing from the scope of the invention. The recited walls define an interior chamber 73. Chamber 72 is divided by at least one wall 76 extending from front to rear and at least two walls 78 and 80 which are perpendicular to wall 76 and which extend across the chamber 72 from side wall to side wall. It will be appreciated that the various chamber walls 76, 78 and 80 are substantially ridged and serve to support the top wall 62 when cushion 60 is placed on a chair. Further, the various walls just described cooperated with the front and rear walls 64 and 66 respectively to divide the body of cushion into a plurality of empty chambers, as at 82. Thus, cushion 60 can be constructed having adequate support without a material thickness requiring addition support or padding material, thereby reducing the weight of the cushion and the material cost. The embodiment of FIGS. 9–13 is best molded as one piece from polyurethane material.

It will be appreciated that another embodiment of the cushion of the present invention can be constructed as follows: a STYROFOAM (formed of polymer material) skeleton having the same configuration as cushion 60, for example, is covered with a soft material such as padded vinyl, leather or so forth. The resulting cushion would have the external appearance of the previously described cushions but would be considerably lighter in weight.

As will be appreciated from the drawings, and particularly FIGS. 3 and 8, when cushion 10 (or 60) is placed upon seat 16 of chair 12, the top wall 30 functions as the seating surface for a user. The top wall 30 thus is elevated at least to, but preferably above the horizontal plane between the apexes of the bows of the leg elements. The bows of the legs elements are nested in the recesses 50 and 52 and eliminated as restrictions on the seating surface of chair 12. Further, the recess hug the legs and secure the cushion into place without the need for addition securing means. Cushion 10 (or 60) is portable and can be removed from the chair and carried about to be placed on another chair, if necessary.

It will be appreciated that various changes and modifications may be made in the cushion of the present invention without departing from the scope of the appended claims. Therefore, the foregoing description and accompanying drawings are intended to be illustrative only and should not be viewed in a limiting sense.

We claim:

1. A combination for increasing the usable seating area of a chair, comprising:

a chair having a seat with a first substantially planar seat surface defining a first seat area, said seat having opposing sides;

support elements attached to the opposing sides of said seat, each support element extending upwardly above the plane of the first seat surface to an uppermost location;

a seat cushion received on the first seat surface and between said support elements, said seat cushion having a second seat surface defining a second seat area at least as great as the first seat area of the first seat surface, and wherein the second seat surface extends substantially in a plane at least as high as a plane containing the uppermost locations of said support elements, said seat cushion having a first side wall and a second side wall;

wherein the first side wall includes a first recess and wherein the second side wall includes a second recess, said support elements being received within the first and second recesses.

2. The combination of claim 1 wherein the second seat area of the second seat surface is greater than the first seat area of the first seat surface.

3. The combination of claim 1 wherein the second seat surface extends substantially in a plane containing the uppermost locations of said support elements.

4. The combination of claim 3 wherein the uppermost locations of said support elements comprise apexes forming arm rests.

5. The combination of claim 4 wherein said support elements are arch shaped tubular leg elements.

6. The combination of claim 5 wherein the first and second recesses frictionally engage said support elements to retain said seat cushion upon the first seat surface.

7. The combination of claim 4 wherein said seat cushion is comprised of a substantially rigid foam material.

8. The combination of claim 7 wherein said seat cushion is substantially covered in vinyl.

9. The combination of claim 4 wherein said seat cushion has a material thickness comprised of a deformable foam rubber.

10. The combination of claim 4 wherein said seat cushion is molded as one piece from polyurethane material.

11. The combination of claim 1 wherein the second seat surface extends substantially in a plane higher than the plane containing the uppermost locations of said support elements.

* * * * *